United States Patent [19]

Garner

[11] 3,989,925

[45] Nov. 2, 1976

[54] PORTABLE DEVICE FOR MELTING ICE AND SNOW

[76] Inventor: Leroy Garner, P.O. Box 652, Grand Marais, Minn. 55604

[22] Filed: Feb. 19, 1975

[21] Appl. No.: 550,980

[52] U.S. Cl. ..... 219/227; 37/16; 126/271.1; 126/343.5 R; 200/61.47; 200/61.85; 219/240

[51] Int. Cl.[2] ..... H05B 11/00; E01H 5/10; F24J 3/00

[58] Field of Search ..... 37/12, 16; 126/271.1, 126/343.5 R; 219/213, 221, 227, 228, 240; 200/61.47, 61.85; 30/140; 15/105

[56] References Cited

UNITED STATES PATENTS

| | | | |
|---|---|---|---|
| 2,027,993 | 1/1936 | Methven | 219/227 X |
| 2,093,419 | 9/1937 | Coleman | 200/61.47 |
| 2,699,614 | 1/1955 | Welch | 37/16 |
| 3,141,955 | 7/1964 | Culpepper | 219/213 |
| 3,771,188 | 11/1973 | Guth | 37/16 X |

*Primary Examiner*—Clifford D. Crowder
*Assistant Examiner*—Steven A. Bratlie
*Attorney, Agent, or Firm*—Wicks & Nemer

[57] ABSTRACT

A portable device for melting ice and snow including a support having a heating device carried by the support together with a handle pivotally mounted on the support and switch device carried by the support for actuating the heating device and deactuating the heating device when the pivotal angular relationship between the support and the handle is changed a given degree.

3 Claims, 8 Drawing Figures

PORTABLE DEVICE FOR MELTING ICE AND SNOW

SUMMARY

The invention herein disclosed relates to an improvement in a device for melting ice and snow and more particularly to a portable device for melting ice and snow which forms on the edges of roofs in the northern climes. When ice forms at the lower edge of a roof and the same alternately melts and freezes it backs up under the roof shingles and when melted the water may enter the walls of the building.

The device includes a support pivotally mounted on a handle which is positioned on the ground. The support carries a heating device and a switch for activating the heating device and deactivating the heating device when the pivotal angular relationship between the support and the handle is changed a given degree due to the melting of the snow and ice upon which the support of the device is placed.

In the drawings forming part of this application:

Figures 1, 2, 3, 4, 5, 6, 7, 8:
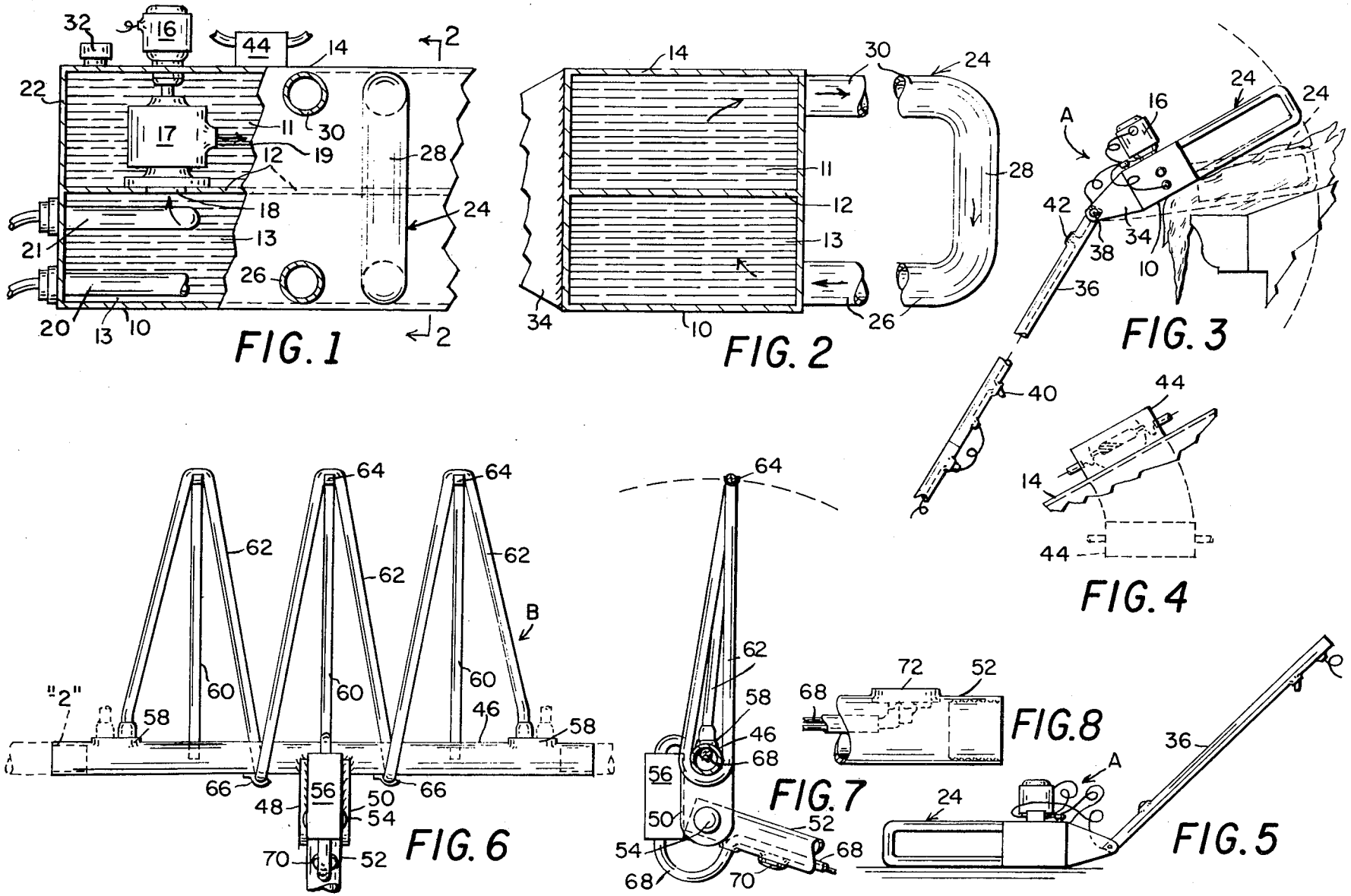
FIG. 1 is a partial sectional view of a portable device for melting ice from a roof with a portion thereof broken away and embodying the invention.
FIG. 2 is a sectional view on the line 2-2 of FIG. 1.
FIG. 3 is a side elevational view of the device in engagement with ice shown as on the edge of a roof with a portion of the handle broken away.
FIG. 4 is a side elevational view of a mercury switch mounted on the housing of the device.
FIG. 5 is a side elevational view of the device in position on a surface for melting ice thereon.
FIG. 6 is a top plan view of a further embodiment of the invention.
FIG. 7 is an end view of the device of FIG. 6.
FIG. 8 is an enlargement of the end of the handle of the device of FIGS. 6 and 7.

Referring to the drawings in detail, the device A for melting ice from a roof or the like includes a housing in the form of the tank 10 which has formed therein the internal wall 12 and which divides the tank into the upper chamber 11 and the lower chamber 13. Mounted on the outside of the top wall 14 of the tank 10 is the conventional electric motor 16 with the shaft thereof extended through the wall 14 and into the chamber 11. The inner end of the motor shaft is connected to the conventional pump 17 which is mounted on the internal wall 12. The intake end of the pump 17 is in communication with the opening 18 formed in the wall 12 and the outlet 19 of the pump is within the upper chamber 11.

The numeral 20 designates a conventional resistance electric heater secured to the tank wall 22 and extending into the chamber 13 of the housing. The heater 20 is controlled by the conventional thermostat 21 by means of conventional wiring in conjunction with the heater. Further provided are a multiplicity of heating and distributing tubes 24 mounted on the tank each of which is U-shaped in configuration and each of which includes a first leg portion 26 terminating in a right angularly disposed end portion 28. The end portion 28 terminates in a second leg portion 30. The inner free end of the first leg portion 26 of each tube 24 is connected to the tank 10 and communicates with the lower chamber 13, and the inner free end of the second leg portion 30 of each tube 24 is connected to the tank and communicates with the upper chamber 11. The tank 10 includes the filler plug 32 whereby a liquid may be introduced into the tank.

Secured to each end of the tank is a support 34, both supports 34 converge and are joined at the outer end of the hollow handle 36 by means of the pin 38 to thereby pivotally mount the tank on the handle. Mounted on the handle 36 is the switch 40 which is wired to a light 42 which in turn is wired to the motor 16 and heater 20. A conventional mercury switch 44 such as Honeywell No. AS435 is mounted on the tank 10 interposed in the line from the switch 40 to the motor 16 and heater 20. The switch 44 is so positioned that when the tank 10 assumes the substantially horizontal position shown in broken lines in FIG. 3 the switch is in an "off" position thereby terminating the operation of the heater and motor of the unit. The light 42 indicates when the device is in operation.

When ice forms at the edge of a roof as illustrated in FIG. 3 and it is desired that it be removed and/or irrigated, the device is positioned upon the ice as illustrated in FIG. 3 with the lower end of the handle resting on the ground. The switch 40 is then turned "on" whereby the heater 20 is turned on together with the pump 16. Water heated by the heater is circulated from the upper chamber 11 through the leg portion 30, the end portion and the leg portion 26 and into the lower chamber for recirculation. As the ice is caused to melt the heating tubes pivotally move through pivot 38 relative to the handle to the position shown in broken lines in FIG. 3 and upon the roof, and in such a position the switch 44 turns the heater and motor off. The device is then removed from the roof for use at other areas of the roof as necessary.

A further embodiment of the invention is shown in FIGS. 6, 7 and 8 wherein is found the device B which includes the elongated hollow support member 46 and secured to the support 46 are the spaced flanges 48 and 50 between which is pivotally mounted the upper end of the handle 52 by means of the pin 54. Mounted on the flanges 48 and 50 is the conventional mercury switch 56. The numeral 58 designates a series of dual electrical outlet plugs mounted on the support 46. Further provided are the spaced heating element supports 60 rigidly secured at the inner ends to the support 46 and extending outwardly from and at right angles to the support. The numeral 62 designates a conventional insulated electrical heating wire one end of which is plugged into an outlet 58 with the wire passed over and within the U-shaped retainer 64 formed on the end of the support 60 from where it is passed around the support 46 and held in place on the support by the clip 66 secured to the support. The electrical heating wire 62 is then passed over further retainers 64 on the ends of supports 60 and thence plugged into an outlet 58 best illustrated in FIG. 6. The support 46 may have another like support screw fit into the same, as at "X," with additional supports 60 and cable 62, the same as the unit shown in FIG. 6.

A wire 68 is positioned inside the support 46 which connects with the mercury switch 56 and outlet plugs 58 and which leads out of the support to the mercury switch 56 from where the wire is connected to the light 70 and down to the outlet female plug 72 to which a source of electrical power is connected. The device B is positioned on the ice on a roof as in FIG. 3 and when the ice melts the device assumes a substantially horizontal position and as it does the mercury switch turns off the power.

It will be seen that either device A or B may be used to melt ice in a flat surface such as a sidewalk, driveway, flat roof or the like.

I claim:

1. A device for melting snow and ice comprising:

a. a support including a tank;

b. heating means carried by said tank including a series of spaced heating tubes mounted on the tank externally thereof and communicating with the interior of the tank, c. a heating element mounted in said tank, d. a support handle, e. said support handle pivotally connected at one end to said tank to allow a change of angular relationship between the tank with the tubes thereon and the handle, f. means for circulating a liquid heated by said heating element through said tank and said heating tubes, g. a switch carried by said tank for deactivating said heating element and said circulating means when the pivotal angular relationship between the tank and the handle is changed a given degree.

2. The device of claim 1 in which said means for circulating a liquid through said tank and said tubes is a pump mounted in said tank.

3. The device of claim 1 in which said tubes are U-shaped in formation.

* * * * *